US011554912B2

(12) United States Patent
Worth

(10) Patent No.: US 11,554,912 B2
(45) Date of Patent: Jan. 17, 2023

(54) REMOVABLE THIEF HATCH PLUG

(71) Applicant: CHESAPEAKE ENERGY CORPORATION, Oklahoma City, OK (US)

(72) Inventor: Landon K. Worth, Kingfisher, OK (US)

(73) Assignee: Chesapeake Energy Corporation, Oklahoma City, OK (US)

( * ) Notice: Subject to any disclaimer, the term of this patent is extended or adjusted under 35 U.S.C. 154(b) by 225 days.

(21) Appl. No.: 17/028,283

(22) Filed: Sep. 22, 2020

(65) Prior Publication Data

US 2022/0089363 A1 Mar. 24, 2022

(51) Int. Cl.
*B65D 90/10* (2006.01)
*B65D 90/28* (2006.01)

(52) U.S. Cl.
CPC ..... *B65D 90/10* (2013.01); *B65D 90/28* (2013.01)

(58) Field of Classification Search
CPC ..... Y10T 292/202; F16J 13/00; F16J 13/16; B65D 51/16; B65D 47/32; B65D 39/02; B65D 39/025; B65D 45/305; B65D 43/22; B65D 43/166; B65D 90/22; B65D 90/10; B65D 90/28
See application file for complete search history.

(56) References Cited

U.S. PATENT DOCUMENTS 6,244,457 B1 * 6/2001 Piotrowski ..... F16K 13/10 220/228
6,929,142 B2 8/2005 Gilbert et al.
7,341,161 B2 * 3/2008 McGuire ..... B01J 3/03 292/256.65
7,658,570 B2 * 2/2010 Hill ..... E02D 29/1418 220/232
9,764,893 B1 * 9/2017 Westmoreland, III ..... B65D 90/22
10,161,521 B2 12/2018 Bartha et al.
2002/0148530 A1 * 10/2002 Caparros ..... B65D 90/48 141/86
2002/0190068 A1 * 12/2002 Sisk ..... B65D 90/10 220/263
2013/0264341 A1 * 10/2013 Cockerham ..... B65D 47/32 220/203.29
2015/0136778 A1 * 5/2015 Johnson ..... B65D 90/34 220/288
2016/0001935 A1 * 1/2016 Smith ..... B65D 47/00 220/327
2017/0138498 A1 * 5/2017 Kayser ..... F16K 27/0209
2018/0274284 A1 9/2018 Bartha et al.

FOREIGN PATENT DOCUMENTS

CA 2716208 8/2009

OTHER PUBLICATIONS

U.S. Environmental Protection Agency, Control of Hydrocarbons from Tank Truck Gasoline Loading Terminals, Guideline Series, Oct. 1977, OAQPS No. 1.2-082, pp. 1-62.

(Continued)

*Primary Examiner* — Kareen K Thomas
(74) *Attorney, Agent, or Firm* — McAfee & Taft

(57) ABSTRACT

The present disclosure provides a removable plug configured to preclude the release of gases through a thief hatch positioned on a hydrocarbon tank.

18 Claims, 6 Drawing Sheets

(56) References Cited

OTHER PUBLICATIONS

U.S. Environmental Protection Agency, Evaluation of Methods for Measuring and Controlling Hydrocarbon Emissions from Petroleum Storage Tanks, Nov. 1976, pp. 1-99.
Air Pollution Control Association, Control of Atmospheric Emissions from Petroleum Storage Tanks, Journal of the Air Pollution Control Association, 21:5, Mar. 15, 2012, pp. 260-268.
Esswein, Eric J., et al., Case Study: Evaluation of Some Potential Chemical Exposure Risks During Flowback Operations in Unconventional Oil and Gas Extraction: Preliminary Results, Journal of Occupational and Environmental Hygiene, Sep. 12, 2014, pp. D174-D184.
The National Institute for Occupational Safety and Health (NIOSH) and the Occupational Safety and Health Administration (OSHA), Health and Safety Risks for Workers Involved in Manual Tank Gauging and Sampling at Oil and Gas Extraction Sites, Publication No. 2016-108, 2016, pp. 1-13.
American Petroleum Institute and Independent Petroi Fum Association of America, Comments of the American Petroleum Institute ("API") and the Independent Petroleum Association of America ("IPAA") in Response to the Occupational Safety & Health Administration ("OSHA") Proposed Rule entitled "Occupational Exposure to Respirable Crystalline Silica", Feb. 11, 2014, pp. 1-82.
Siemens Industry, Inc., Reduce the Risks of Tank Gauging by Using Work Practice Control, 2017, pp. 1-2.

* cited by examiner

REMOVABLE THIEF HATCH PLUG

BACKGROUND

Servicing of hydrocarbon storage tanks frequently requires opening of a hatch known as the "thief hatch." Unfortunately, opening of the thief hatch will release gases from the tank to the atmosphere. Workers in the vicinity of the thief hatch will be exposed to higher concentrations of hydrocarbon gases. As a result, these workers must frequently wear respirators designed to protect them from hydrocarbon gases. The industry would benefit from an apparatus or system configured to block the release of hydrocarbon gases through the thief hatch during servicing of the thief hatch. In particular, a need exists for a device which securely fits within the thief hatch without blocking the top lip or flange of the hatch thereby permitting servicing of the top lip without exposing the worker to hydrocarbon gases.

SUMMARY

In one embodiment, the present disclosure describes an apparatus configured to substantially preclude the release of gases through a hatch in a tank. The apparatus functions as a plug within the opening of the hatch. The apparatus includes:

a first rigid plate having a first diameter and a first center hole;

a second rigid plate having a second diameter and a second center hole, where the second diameter is less than the first diameter;

a flexible disk having a third diameter and a third center hole, where the third diameter is greater than the first diameter, the flexible disk positioned between the first rigid plate and the second rigid plate;

a shaft passing through the first center hole, the second center hole and the third center hole, a first end of the shaft protrudes beyond the first rigid plate and the first end of the shaft carries threads, a second end of the shaft protrudes beyond the second rigid plate and carries a handle;

first and second laterally extending arms carried by either the second end of the shaft or the handle;

a first nut positioned on the first end of the shaft; and, a second nut positioned on the second end of the shaft adjacent to the second rigid plate, the first nut and the second nut biases the first rigid plate and the second rigid plate against the flexible disk.

BRIEF DESCRIPTION OF THE DRAWINGS

FIG. 6 provides an exploded view of the thief hatch plug.

DETAILED DESCRIPTION

The drawings included with this application illustrate certain aspects of the embodiments described herein. However, the drawings should not be viewed as exclusive embodiments. The subject matter disclosed is capable of modification or alteration in form and function, as will occur to those skilled in the art with the benefit of this disclosure.

Figure 1:
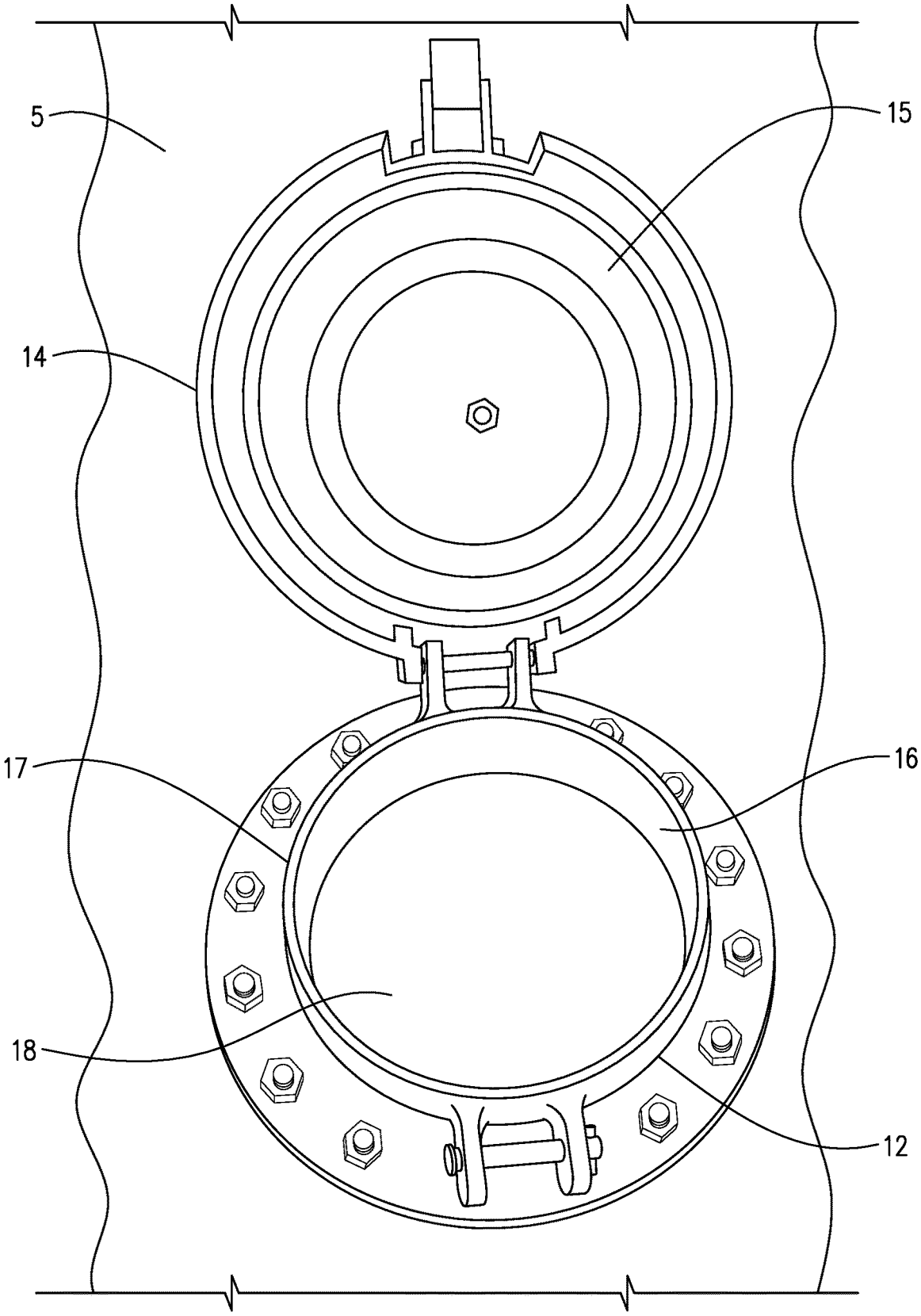
FIG. 1 depicts the opening of a thief hatch.

The hatch plug 10 disclosed herein is particularly suited for use in a thief hatch 12 as commonly found on hydrocarbon storage tanks 5. See FIG. 1. Hatch plug 10 has sufficient flexibility to provide a seal against the interior wall 16 of the thief hatch opening 18. The resulting seal is sufficient to substantially preclude release of gas from the tank during servicing of thief hatch 12.

Figure 2:
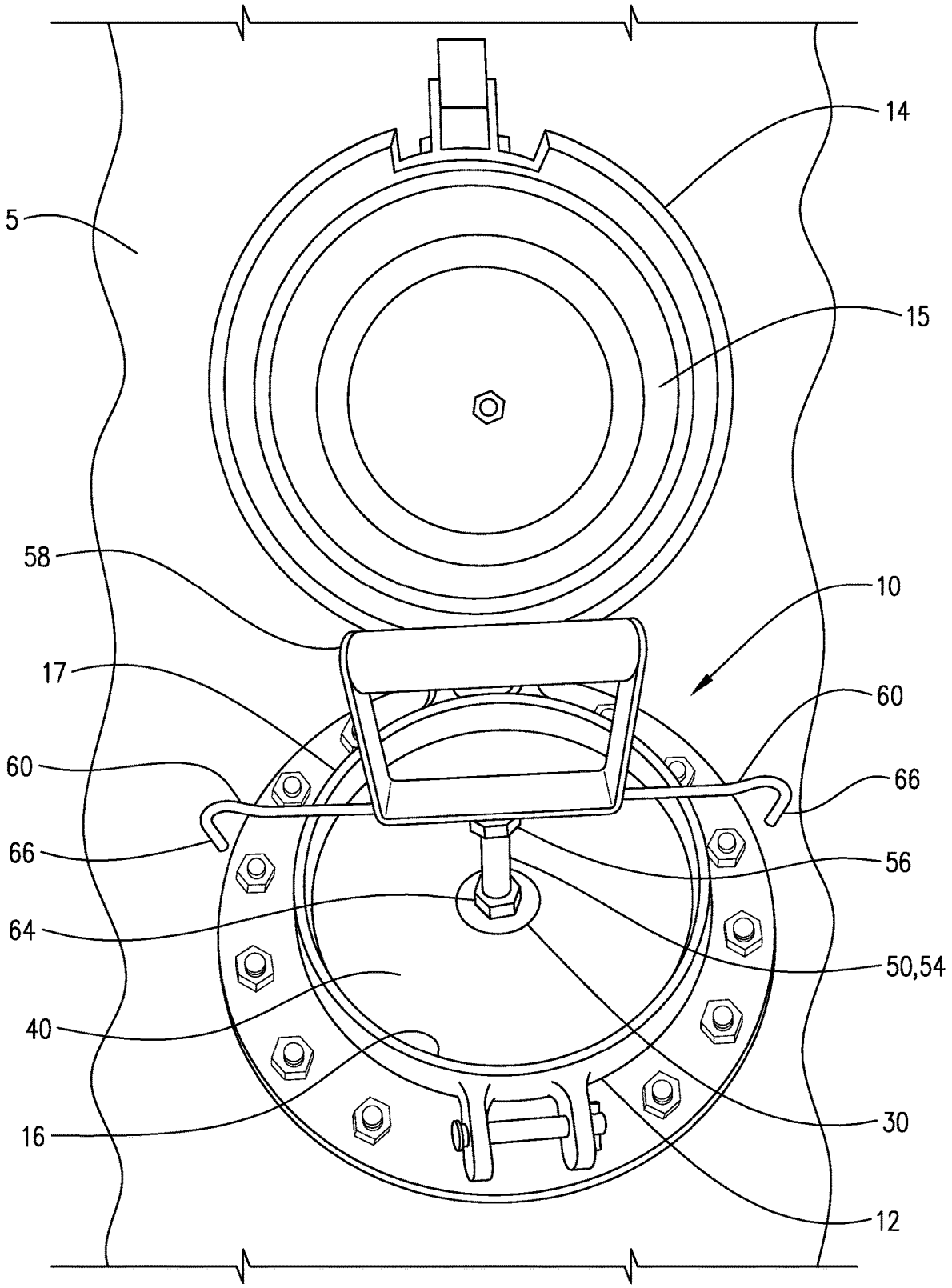
FIG. 2 depicts the thief hatch plug positioned within the opening of a thief hatch.
Figure 5:
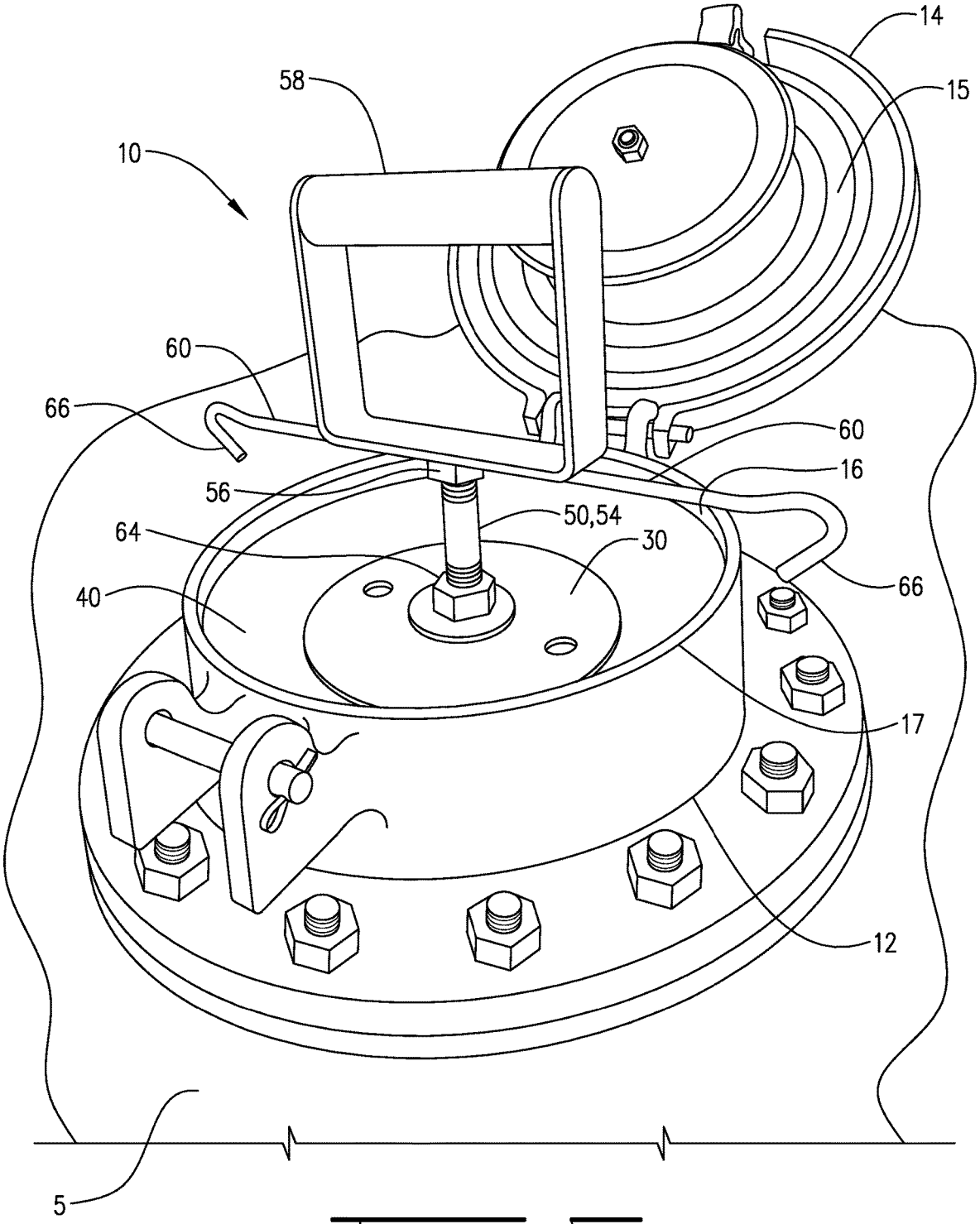
FIG. 5 depicts an alternative embodiment of the thief hatch plug positioned within the opening of a thief hatch.
Figure 5:
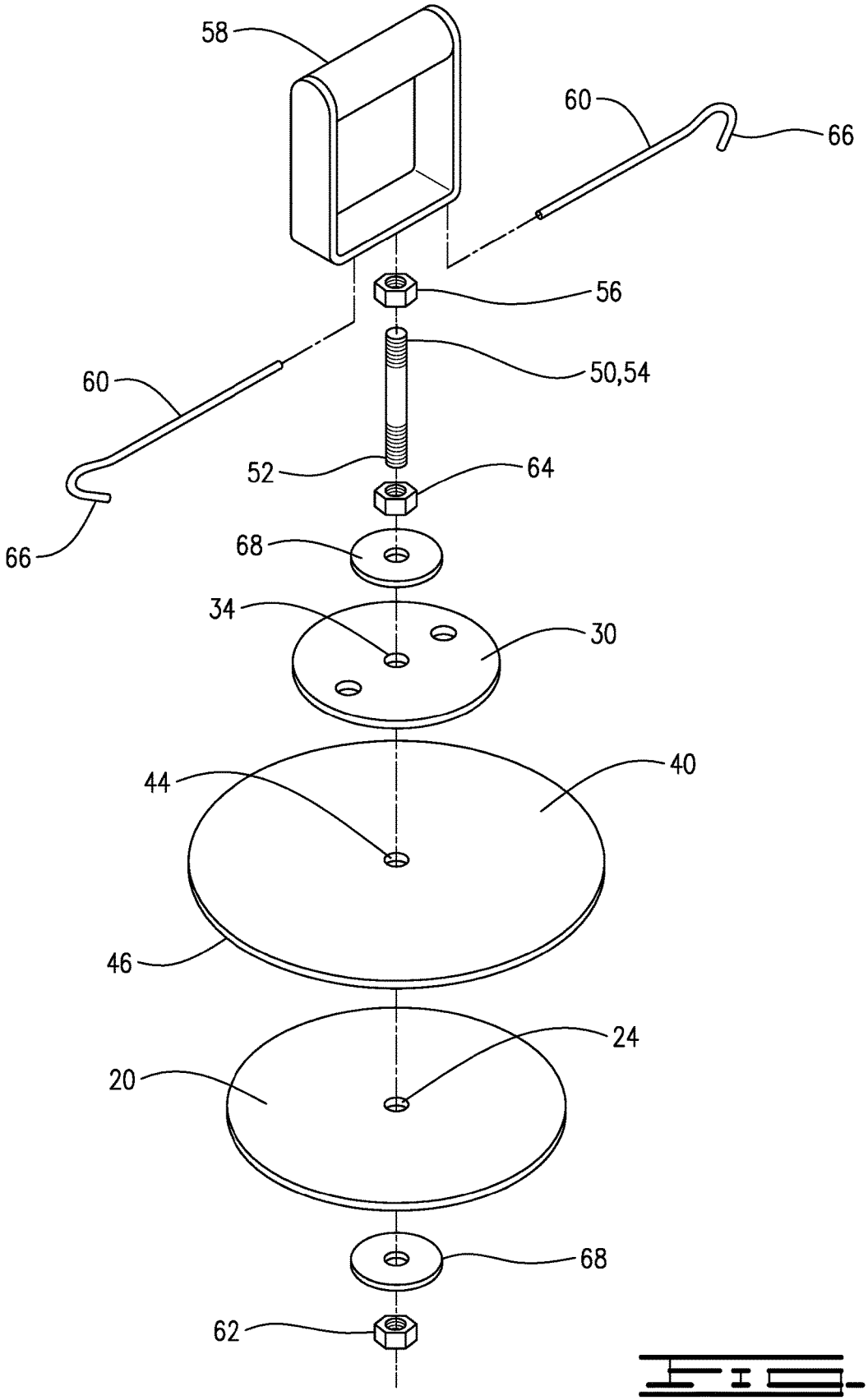

FIGS. 2 and 5 depict hatch plug 10 positioned within opening 18 of thief hatch 12. As defined by wall 16, opening 18 typically has a diameter of about 8". Thief hatch 12 has a lid 14 which includes a gasket 15 suitable for providing a seal when in contact with wall 16. Servicing of thief hatch 12, for example, replacement of gasket 15 and cleaning of top lip 17, requires leaving lid 14 in the open position for an extended period of time. Even if tank 5 is empty, residual gases commonly remain in the tank and will evolve through opening 16 presenting a potential health risk to those servicing thief hatch 12.

The configuration of hatch plug 10 provides a temporary seal precluding release of hydrocarbon gases from tank 5. As depicted in the FIGS., hatch plug 10 includes a flexible disk 40 sandwiched between a first rigid plate 20 and a second rigid plate 30. Flexible disk 40, first rigid plate 20 and second rigid plate 30 each have a center hole, 44, 24 and 34 respectively. A shaft 50 passes through each center hole 24, 34, and 44. Shaft 50 has a first end 52 and a second end 56. Second end 56 terminates in a handle 58. Laterally extending arms 60 may be carried by either shaft 50 or handle 58. For simplicity in manufacturing, shaft 50 will normally carry threads 54 along its entire length. At a minimum, a sufficient length of first end 52 will be threaded to support a nut 62 and a sufficient length of shaft 50 protruding beyond center hole 34 will be threaded to support a nut 64. In most instances, each nut 62 and 64 will be paired with a washer 68. Tightening of nuts 62 and 64 secures first rigid plate 20 and second rigid plate 30 against flexible disk 40.

As depicted in the FIGS., flexible disk 40 has a diameter greater than the interior opening of thief hatch 12 as defined by wall 16. Generally, the diameter of flexible disk 40 will be between about 3% and about 9% greater than the interior opening of thief hatch 12 as defined by wall 16. Typically, disk 40 will be about 6.25% greater than the interior opening of thief hatch 12 as defined by wall 16. Typically, flexible disk 40 will have a diameter about 8.25 inches to about 9 inches and a thickness of about 0.125 inch to about 0.375 inches. For an eight inch thief hatch opening 18, the diameter of disk 40 will normally be about 8.5 inches with a thickness of about 0.125 inch to about 0.25 inch. Materials suitable for use as flexible disk 40 include, but are not limited to, Viton Rubber and other polymeric materials that resist degradation by hydrocarbons. The thickness of flexible disk 40 may vary with the flexibility of the material used in forming disk 40.

First rigid plate 20, the bottom plate, has a diameter less than the diameter of flexible disk 40. First rigid plate 20 may have a diameter of about 12% smaller than the diameter of flexible disk 40. In general, first rigid plate 20 is sized to just fit within thief hatch opening 18. However, a variety of sizes will perform satisfactorily for first rigid plate 20 such that the diameter of plate 20 may range from about 6.5 inches to just less than the diameter of thief hatch opening 18. First rigid plate 20 will commonly be prepared from any conventional metal such as steel, aluminum or brass. Optionally, rigid plastics may be used for first rigid plate 20. The material from which first rigid plate 20 is prepared is not critical to hatch plug 10. Rather, the ability to support and stabilize flexible disk 40 is of primary concern. While the thickness of first rigid plate 20 may vary based on the material used, a typical thickness will be about 0.0625 inch to about 0.125 inch.

Figure 3:
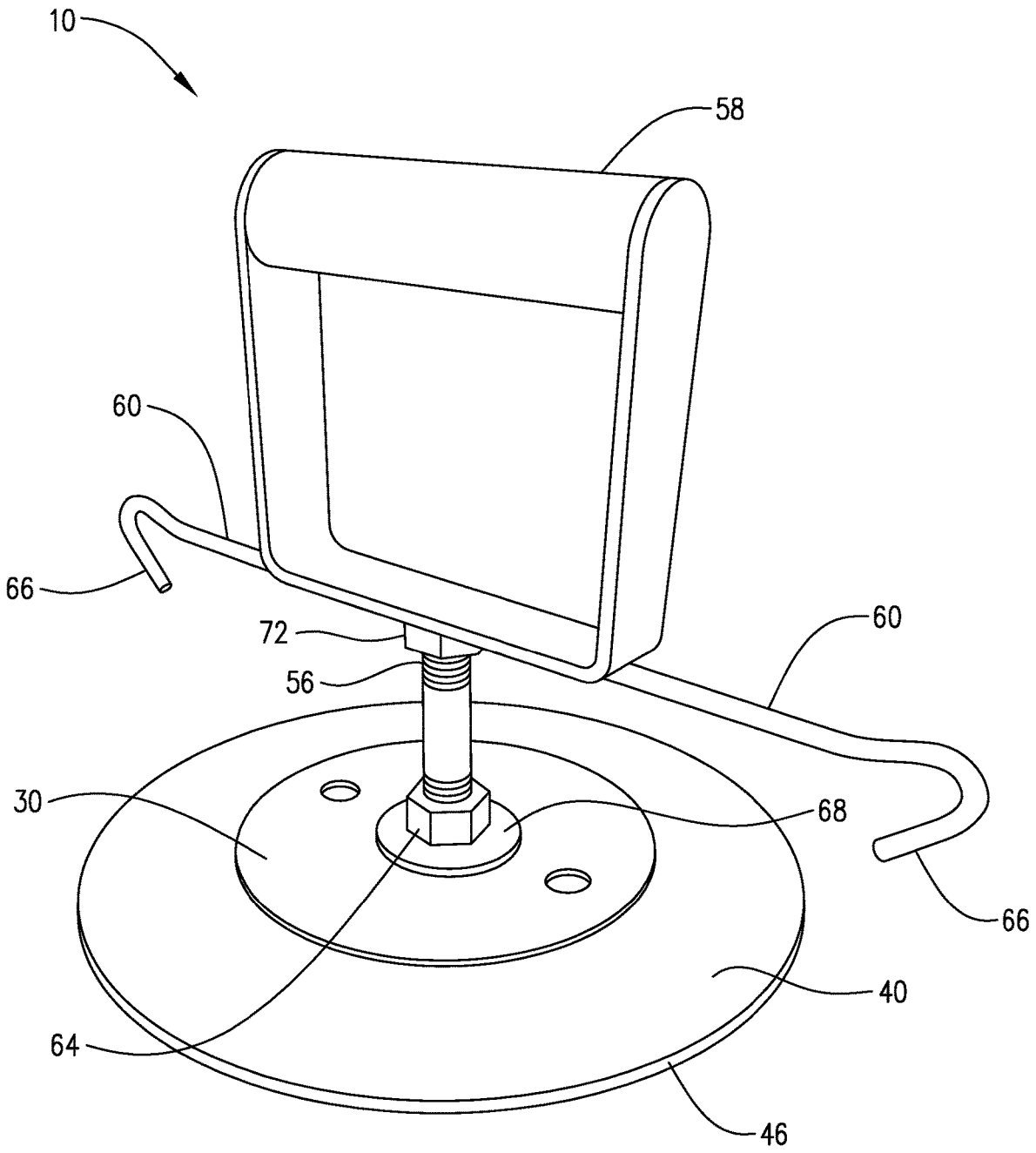
FIG. 3 is a top perspective view of the thief hatch plug.
Figure 4:
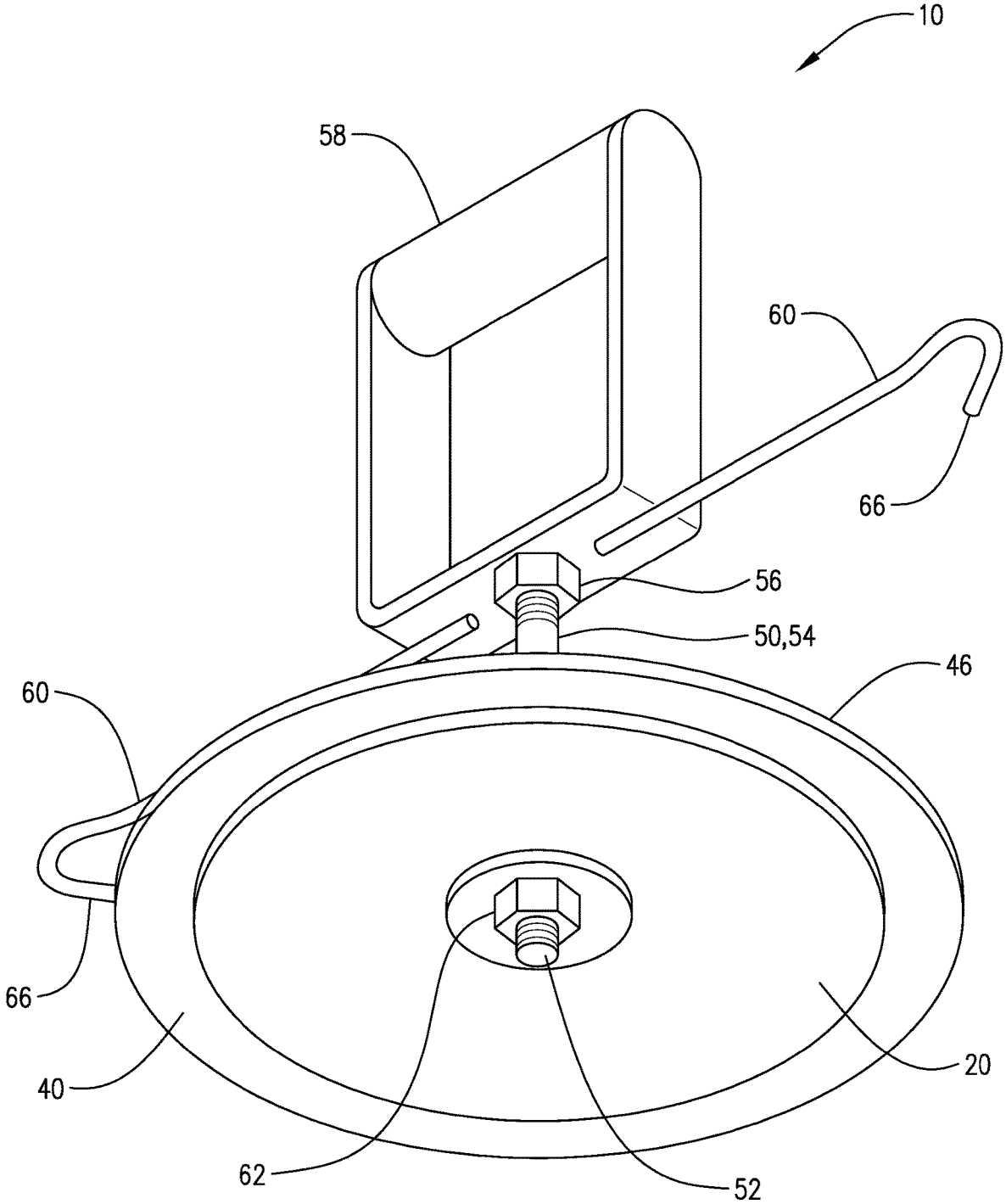
FIG. 4 is a bottom perspective view of the thief hatch plug.

Second rigid plate 30, the top plate, has a diameter less than the diameter of first rigid plate 20 and less than the diameter of flexible disk 40. Thus, second rigid plate 30 more readily permits the upward deflection of flexible disk 40 during positioning of hatch plug 10 in an open thief hatch 12. Second rigid plate 30 may have a diameter that is about 35% to 45% less than the diameter of flexible disk 40. When configured for use in an eight inch diameter thief hatch opening, a typical second rigid plate 30 will have a diameter of about 4.5" to 5.5" inches. However, second rigid plate 30 may have a diameter as small as 1.5 inches as depicted in FIG. 2. FIG. 3 provides an example of a 5 inch plate 30. Second rigid plate 30 will commonly be prepared from any conventional metal such as steel, aluminum or brass. Optionally, rigid plastics may be used for first rigid plate 20. The material from which second rigid plate 30 is prepared is not critical to hatch plug 10. Rather, the ability to support and stabilize flexible disk 40 while permitting the desired flexibility is of primary concern. While the thickness of second rigid plate 30 may vary based on the material used, a typical thickness may be between about 0.0625 inch to about 0.125 inch.

To improve removability of hatch plug 10 from thief hatch opening 18, first rigid plate 20 preferably has a size proximate to the diameter of thief hatch opening 18. As used herein, the phrase "proximate to" means a diameter which will permit the first rigid plate 20 to just slide through thief hatch opening 18. For example, if thief hatch opening 18 has an 8 inch diameter, then first rigid plate 20 may have a diameter up to about 7.95 inches. Thus, first rigid plate 20 limits downward flexing of flexible disk 40 when hatch plug 10 is pulled upward and out of thief hatch opening 18. Likewise, the smaller size of second rigid plate 30 permits upward flexing of flexible disk 40. Thus, during placement of hatch plug 10 in thief hatch opening 18, outer edge 46 displaces upward and provides a seal against interior wall 16 of thief hatch opening 18. However, second rigid plate 30 provides sufficient pressure against flexible disk 40 to ensure adequate frictional force against interior wall 16 such that hatch plug 10 is retained within thief hatch opening 18.

Thus, the size and flexibility of flexible disk 40, in cooperation with first rigid plate 20 and second rigid plate 30, provides a seal against gas leaks and flexibly retains hatch plug 10 within thief hatch opening 18. Further, when installed in thief hatch opening 18, the configuration of hatch plug 10 permits unobstructed cleaning of top lip 17 and servicing of thief hatch lid 14.

As noted above, handle 58 is carried or secured to second end 56 of shaft 50. Handle 58 may be secured by any convenient means including but not limited to welding or threading onto shaft 58. As depicted in FIGS. 2-5, a nut 72 has been welded to handle 58 to permit attachment to second end 56 of shaft 50. FIGS. 2-3 and 5 also depict first and second laterally extending arms 60 as carried by handle 58. However, first and second laterally extending arms 60 may optionally be carried directly by shaft 50. For example, first and second laterally extending arms 60 may be welded to a nut, not shown, and threaded onto shaft 50.

As depicted in FIGS. 2-3 and 5, first and second laterally extending arms 60 are configured to prevent the accidental passage of hatch plug 10 through thief hatch opening 18. Thus, first and second laterally extending arms 60 will have a total length greater than the diameter of thief hatch opening 18. Typically, each arm 60 will extend outward about four inches to about six inches when measured from shaft 50. Additionally, first and second laterally extending arms 60 will have sufficient rigidity and strength to support the weight of hatch plug 10. Optionally, extending arms 60 may terminate with a downward projecting length in the form of a hook 66. In the event plug 10 accidentally passes completely through thief hatch opening 18, hook 66 will catch on top lip 17 thereby precluding loss of plug 10 to the interior of tank 5.

The final flexibility of flexible disk 40 is partially determined by the pressure applied against flexible disk 40 by first rigid plate 20 and second rigid plate 30. When assembled with flexible disk 40 sandwiched between first rigid plate 20 and second rigid plate 30, the force applied by nuts 62 and 64, with optional washers 68, in conjunction with the selected sizes of plates 20 and 30 will determine the degree of freedom or flexibility experienced by flexible disk 40. Thus, nuts 62 and 64 bias or force first rigid plate 20 and second rigid plate 30 against flexible disk 40. If nuts 62 and 64 are torqued to the maximum permitted by the type of threads 54 and structural nature of shaft 50 and nuts 62, 64, then the degree of flex experienced by disk 40 will be determined by the relative diameters of first rigid plate 20 and second rigid plate 30. The nuts and washers allow the user to adjust the depth that flexible disk 40 is set in thief hatch opening 18.

Use of hatch plug 10 entails positioning hatch plug 10 in thief hatch opening 18. Hatch plug 10 is pushed into thief hatch opening 18 a sufficient distance such that outer edge 46 of flexible disk 40 engages wall 16 and outer edge 46 deflects upward when compared to the plane defined by second rigid plate 30. The degree of deflection will vary with the diameter of second rigid plate 30 and the flexibility of disk 40.

As discussed above, removal of hatch plug 10 is aided by the larger diameter of first rigid plate 20 as compared to the diameter of second rigid plate 30. The larger diameter of first rigid plate 20 limits the reverse deflection of flexible disk 40 and limits binding of flexible disk 40 within thief hatch opening 18.

Other embodiments of the present invention will be apparent to one skilled in the art. As such, the foregoing description merely enables and describes the general uses and methods of the present invention. Accordingly, the following claims define the true scope of the present invention.

What is claimed is:

1. An apparatus configured to substantially preclude the release of gases through a hatch in a tank, said tank having a thief hatch opening, said apparatus comprising:

a first rigid plate having a first diameter and a first center hole;

a second rigid plate said second rigid plate having a second diameter;

a flexible disk said flexible disk having a third diameter, said flexible disk positioned between said first rigid plate and said second rigid plate;

a shaft passing through said first center hole, a second center hold and a third center hole, a first end of said shaft protrudes beyond said first rigid plate and said first end of said shaft carries threads, a second end of said shaft protrudes beyond said second rigid plate and carries a handle;

a first nut positioned on said first end of said shaft; and, a second nut positioned on said shaft adjacent to said second rigid plate, said first nut and said second nut retain said first rigid plate, said second rigid plate and said flexible disk on said shaft.

2. The apparatus of claim 1, wherein said third diameter is from about 8.25 inches to about 9 inches.

3. The apparatus of claim 1, wherein said first diameter is about 12% smaller than the third diameter.

4. The apparatus of claim 1, wherein said first diameter is a diameter proximate to the diameter of said thief hatch opening.

5. The apparatus of claim 1, wherein said first diameter is from about 6.5 inches to 7.95 inches.

6. The apparatus of claim 1, wherein said second diameter is about 35% to about 45% less than the third diameter.

7. The apparatus of claim 1, wherein said second diameter is about 4.5 inches to about 5.5 inches.

8. The apparatus of claim 1, wherein said laterally extending arms are carried by said second end of said shaft and each of said laterally extending arms extends outward from said shaft a distance of about four inches to about six inches.

9. The apparatus of claim 1, wherein each of said laterally extending arms terminates in a downward projecting hook.

10. An apparatus configured to substantially preclude the release of gases through a hatch in a tank, said tank having a thief hatch opening, said apparatus comprising:

a first rigid plate having a first diameter and a first center hole;

a second rigid plate said second rigid plate having a second diameter where said second diameter is less than said first diameter and having a second center hole;

a flexible disk said flexible disk having a third diameter where said third diameter is greater than said first diameter and having a third center hole, said flexible disk positioned between said first rigid plate and said second rigid plate;

a shaft passing through said first center hole, said second center hole and said third center hole, a first end of said shaft protrudes beyond said first rigid plate and said first end of said shaft carries threads, a second end of said shaft protrudes beyond said second rigid plate and carries a handle;

first and second laterally extending arms carried by either said second end of said shaft or said handle;

a first nut positioned on said first end of said shaft; and, a second nut positioned on said shaft adjacent to said second rigid plate, said first nut and said second nut bias said first rigid plate and said second rigid plate against said flexible disk.

11. The apparatus of claim 10, wherein said third diameter is from about 8.25 inches to about 9 inches.

12. The apparatus of claim 10, wherein said first diameter is about 12% smaller than the third diameter.

13. The apparatus of claim 10, wherein said first diameter is a diameter proximate to the diameter of said thief hatch opening.

14. The apparatus of claim 10, wherein said first diameter is from about 6.5 inches to 7.95 inches.

15. The apparatus of claim 10, wherein said second diameter is about 35% to about 45% less than the third diameter.

16. The apparatus of claim 10, wherein said second diameter is about 4.5 inches to about 5.5 inches.

17. The apparatus of claim 10, wherein said laterally extending arms are carried by said second end of said shaft and each of said laterally extending arms extends outward from said shaft a distance of about four inches to about six inches.

18. The apparatus of claim 10, wherein each of said laterally extending arms terminates in a downward projecting hook.

* * * * *